US009004604B2

(12) United States Patent
Bogard et al.

(10) Patent No.: US 9,004,604 B2
(45) Date of Patent: Apr. 14, 2015

(54) INSTALLATION OF A TEXTILE DECK ASSEMBLY IN AN ARTICLE OF FURNITURE

(75) Inventors: Jeremy Bogard, Murray, KY (US); Mark Mazza, Greensboro, NC (US); Bernard R. Simon, Whitsett, NC (US); Larry I. Bullard, Winston-Salem, NC (US)

(73) Assignee: L&P Property Management Company, South Gate, CA (US)

( * ) Notice: Subject to any disclaimer, the term of this patent is extended or adjusted under 35 U.S.C. 154(b) by 580 days.

(21) Appl. No.: 13/363,613

(22) Filed: Feb. 1, 2012

(65) Prior Publication Data

US 2012/0153703 A1 Jun. 21, 2012

Related U.S. Application Data

(63) Continuation-in-part of application No. 12/700,205, filed on Feb. 4, 2010, now Pat. No. 8,136,884.

(60) Provisional application No. 61/149,938, filed on Feb. 4, 2009.

(51) Int. Cl.

| | |
|---|---|
| ***A47C 7/02*** | (2006.01) |
| ***A47C 7/28*** | (2006.01) |
| ***A47C 31/02*** | (2006.01) |
| ***B68G 7/12*** | (2006.01) |

(52) U.S. Cl.

CPC ..... *A47C 7/28* (2013.01); *A47C 31/026* (2013.01); *B68G 7/12* (2013.01)

(58) Field of Classification Search

CPC ..... A47C 7/282; A47C 31/02; B29C 45/0053

USPC ..... 297/452.13; 29/448, 91.1, 91.5; 160/378

See application file for complete search history.

(56) References Cited

U.S. PATENT DOCUMENTS

| | | | |
|---|---|---|---|
| 71,352 | A | 11/1867 | Wilson |
| 975,358 | A | 11/1910 | Hefter |
| 1,765,795 | A | 6/1930 | Kessler |
| 2,052,811 | A | 9/1936 | Suekoff |
| 2,085,475 | A | 6/1937 | Saives |
| 2,341,419 | A | 2/1944 | Bank |

(Continued)

FOREIGN PATENT DOCUMENTS

GB 2028120 A 3/1980

OTHER PUBLICATIONS

Nonfinal Office Action, mailed Jun. 27, 2011, in U.S. Appl. No. 12/700,205, 18 pp.

*Primary Examiner* — Laurie Cranmer

(74) *Attorney, Agent, or Firm* — Shook, Hardy & Bacon LLP

(57) ABSTRACT

A method, apparatus, and seating product that include a seat deck assembly with a tensioned fabric decking are described. The seat deck assembly includes one or a pair of frame rails attached along opposite edges of the decking. The decking includes an elastomeric textile. The decking or a first of the frame rails is attached to a first side of the frame. The second of the frame rails is placed in a rigid fixture. A force is applied by an actuator to the frame to move the second side of the frame toward the second frame rail and to stretch the elastomeric fabric. The second frame rail is couple to the second side of the frame and the assembled frame is removed from the fixture. Cushions, padding or an upholstered covering can complete embodiments of the seating product.

20 Claims, 10 Drawing Sheets

(56) References Cited

U.S. PATENT DOCUMENTS

| | | | | |
|---|---|---|---|---|
| 3,037,766 | A | 6/1962 | Berg | |
| 3,137,490 | A | 6/1964 | Reed | |
| 3,245,091 | A | 4/1966 | Spitz | |
| 3,384,148 | A | 5/1968 | Sarginson et al. | |
| 3,497,883 | A | 3/1970 | Arnold et al. | |
| 3,610,688 | A | 10/1971 | Freehan et al. | |
| 3,695,706 | A | 10/1972 | Basher | |
| 3,902,756 | A | 9/1975 | Chubb et al. | |
| 3,972,079 | A | 8/1976 | Shellow | |
| 4,136,410 | A | 1/1979 | Vandenbark | |
| 4,285,080 | A | 8/1981 | Kitchen et al. | |
| 4,516,305 | A * | 5/1985 | Unger | 29/448 |
| 4,842,257 | A | 6/1989 | Abu-Isa et al. | |
| 4,883,320 | A | 11/1989 | Izumida et al. | |
| 4,928,334 | A | 5/1990 | Kita et al. | |
| 5,509,842 | A * | 4/1996 | Nosker | 445/37 |
| 5,624,161 | A | 4/1997 | Sorimachi et al. | |
| 6,070,942 | A | 6/2000 | Barton et al. | |
| 6,116,694 | A | 9/2000 | Bullard | |
| 6,199,251 | B1 * | 3/2001 | Zeiler | 29/33 R |
| 6,234,578 | B1 | 5/2001 | Barton et al. | |
| 6,292,990 | B1 * | 9/2001 | Iseki et al. | 29/91.1 |
| 6,478,381 | B1 | 11/2002 | Cramb, III et al. | |
| 6,676,218 | B2 | 1/2004 | Fujita et al. | |
| 7,556,317 | B2 * | 7/2009 | Bottemiller | 297/440.11 |
| 7,837,273 | B1 * | 11/2010 | Ratza et al. | 297/452.56 |
| 8,465,007 | B2 * | 6/2013 | Coffield et al. | 267/142 |
| 8,490,271 | B2 * | 7/2013 | Harvilchuck et al. | 29/448 |
| 8,528,182 | B2 * | 9/2013 | Bogard | 29/449 |

* cited by examiner

INSTALLATION OF A TEXTILE DECK ASSEMBLY IN AN ARTICLE OF FURNITURE

CROSS-REFERENCE TO RELATED APPLICATIONS

This application is a continuation-in-part of U.S. patent application Ser. No. 12/700,205, filed Feb. 4, 2010, and titled "Textile-Attached Deck Assembly," which claims the benefit of U.S. Provisional Patent Application No. 61/149,938, filed Feb. 4, 2009, and titled "Textile-Attached Seating System," the disclosures of each of which are hereby incorporated herein in their entirety by reference.

BACKGROUND

In an article of furniture, such as a sofa, loveseat, or chair among others, the decking provides a flexible surface that supports a seating surface, or in some instances, comprises the seating surface. The decking might be covered with one or more materials and cushions to provide a desired aesthetic and comfort level. Historically, a wire grid supported by a number of helical springs was used for decking materials. Furniture manufactures have since begun using elastomeric or other stretchable fabrics for decking instead of or in addition to wire grids and helical springs.

Fabric decking is typically stretched between a pair of opposing frame rails to provide the desired tension or stiffness in the decking. Such a process has several drawbacks: excess material must be used to allow the material to be grasped during stretching; the material is prone to ripping and/or tearing when it is attached under tension; automation of the process is difficult; and operators are subjected to repetitive, strenuous manual activities during installation.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter. In brief and at a high level, this disclosure describes, among other things, apparatus and ways to tension and install a fabric decking into an article of furniture.

In an embodiment, opposite edges of a fabric decking of a determined width are each attached to a respective frame rail. A first of the frame rails is coupled to a frame of an article of furniture while a second of the frame rails is removeably disposed in a fixture. The frame of the article is moved in a direction perpendicular to the length of the first and second frame rails to stretch the fabric decking therebetween and to bring the second frame rail into contact with a portion of the frame opposite the attachment of the first frame rail. The second frame rail is coupled to the frame and the assembled frame with decking is removed from the fixture.

In another embodiment, an apparatus for installing a fabric decking in a frame of an article of furniture is provided. The apparatus includes a number of fixtures that are configured to removeably but rigidly retain a frame rail that is coupled to a fabric decking. One or more pneumatic or hydraulic cylinders are also provided along with an associated push bar. The fixtures and the cylinders are mounted to a surface in order to retain their orientation with respect to one another. The fixtures and cylinders are also mounted in a configuration that allows the frame of an article of furniture to be overlaid on the surface with a wall of the frame disposed between the fixtures and the push bar of the cylinders. As such, upon actuation of the cylinders, the push bar contacts and presses against the wall of the frame to move it toward the fixtures a sufficient distance to bring a frame rail disposed in the fixtures into contact with the wall of the frame. The movement stretches the fabric decking and the contact between the frame rail and the wall of the frame is maintained to allow coupling of the two components together.

DESCRIPTION OF THE DRAWINGS

Illustrative embodiments of the invention are described in detail below with reference to the attached drawing figures, and wherein.

DETAILED DESCRIPTION

The subject matter of select embodiments of the invention is described with specificity herein to meet statutory requirements. But the description itself is not intended to necessarily limit the scope of claims. Rather, the claimed subject matter might be embodied in other ways to include different steps, components, or combinations thereof similar to the ones described in this document, in conjunction with other present or future technologies. Terms should not be interpreted as implying any particular order among or between various steps herein disclosed unless and except when the order of individual steps is explicitly described.

Figure 1:
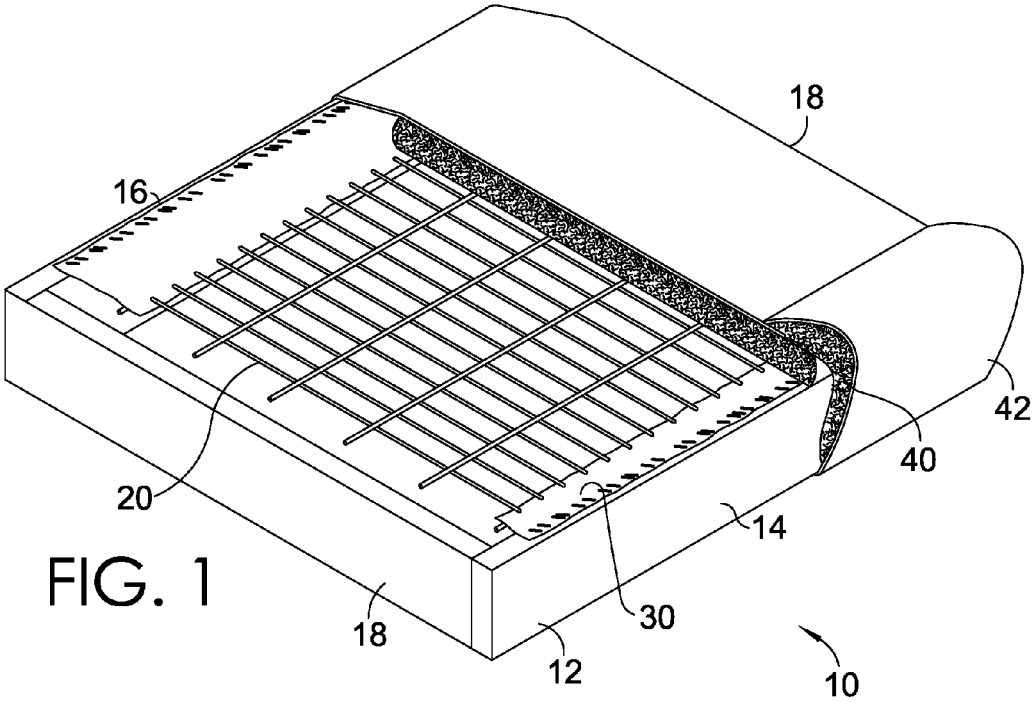
FIG. 1 is a partial cut-away perspective view of a seating product in accordance with an embodiment of the invention.

Referring to the drawings, and particularly to FIG. 1, there is illustrated a seating product 10. The seating product 10 may be, for example, a seat section or a back section of a chair, sofa, love seat, sectional, or any other article of furniture. The seating product 10 comprises a frame 12 and deck assembly 20 secured to the frame. The deck assembly can include a wire grid assembly 20 (as illustrated in the embodiment depicted in FIG. 1) or a fabric deck. One or more layers of padding 40 may cover one or more surfaces of the seating product. A covering 42 may be disposed over the padding 40.

As illustrated in FIG. 1, the frame 12 comprises a front rail 14, a rear rail 16 and a pair of opposed side rails 18. The front and rear rails 14, 16 comprise a pair of opposed rails. The frame 12 may be constructed by any material known and used in the art, and is typically constructed from wood. The size of the frame 12 will vary depending on the application, and may be adapted for use, for example, as a seat section or a seat back of a piece of furniture.

A wire grid assembly 20 is illustrated in FIG. 1 as extending between the front rail 14 and the rear rail 16 of the frame 12. The wire grid assembly may be any such assembly known and used in the art, and the construction of the assembly is not limited by the description herein. For example, in one embodiment, the wire grid assembly may be an assembly such as the Perma-Eze™ or Perma-Eze-Plus™ Grid Construction as manufactured and sold by the Flex-O-Lators division of Leggett & Platt®, Incorporated. In such an embodiment, the wire grid assembly includes 1" spaced 18 gauge oil-tempered spring wires which pierce HDPE tubing center cords. The spring wires are "lock-knotted" around 12 gauge oil-tempered border wires. The border wires may be covered with kraft-paper, plastic, or any other appropriate material.

Figure 2:
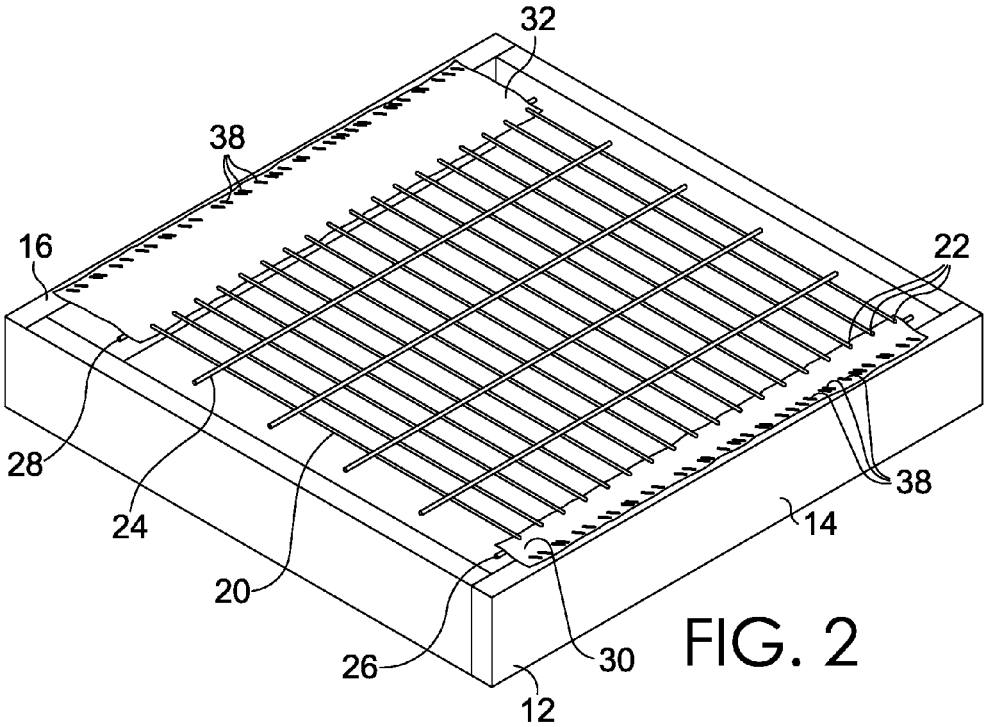
FIG. 2 is a perspective view of a portion of the seating product of FIG. 1 in accordance with an embodiment of the invention.

In another embodiment, as illustrated in FIG. 2, the wire grid assembly 20 comprises a plurality of spaced spring wires 22, which are secured at each end to a pair of border wires 26, 28 which are arranged perpendicularly to the spring wires 22. The spring wires 22 are held in place with one or more center cords 24. The spring wires 22 may pierce the center cords 24 or may be coupled to the center cords 24 in any other manner known in the art. In one embodiment, the spring wires may have a plastic coating that helps protect them from wear. In other embodiments, the spring wires may be coated with a different material or left uncoated.

The wire grid assembly 20 extends between the front rail 14 of the frame 12 and the rear rail 16 of the frame 12. A front end of the wire grid assembly 20 is coupled to the front rail 14 of the frame 12. As shown in FIGS. 1 and 2, this coupling may be achieved by disposing a textile border 30 between the wire grid assembly and the front rail 14 of the frame 12. This textile border 30 may be made of elastomeric fabric or non-elastic fabric. The textile border 30 may be secured to the wire grid assembly 20 by weaving the border 30 into the wire grid assembly 20 during manufacture. In other embodiments, the textile border 30 may be secured to the wire grid assembly 20 by any number of other methods. In an embodiment, the textile border 30 may be further secured to the frame 12 with standard upholstery staples 38, as shown in FIG. 2.

As shown in FIG. 2, the wire grid assembly 20 may be flexibly coupled to the rear rail 16 of the frame 12. The flexible coupling may be achieved, for example, by disposing a second textile border 32 between the wire grid assembly 20, adjacent to border wire 28, and the rear rail 16 of the frame 12. As with the first textile border 30 described above, the second textile border 32 may be made of elastomeric fabric or non-elastic fabric. For example, the textile border of the present invention may be made of any number of woven or nonwoven fabric materials. One such type of webbing material is a polyester material trademarked "SYTEX®", manufactured by the MATREX® division of Leggett & Platt®, Incorporated. A second alternative type of webbing material suitable for making a textile border used in the present invention is a woven polypropylene material containing rubber or elastomeric filaments. Another alternative type of webbing material suitable for making a textile border used in the present invention is a laterally-stretchable warp knit fabric such as, for example, the laterally-stretchable fabric described in U.S. application Ser. No. 12/700,336, filed Feb. 4, 2010, and entitled "Laterally-Stretchable Knit Fabric," the entirety of which is incorporated herein by reference. However, these are just three examples of any number of materials that may be used for the textile border in the present invention.

In one embodiment, the second textile border 32 comprises an elastomeric fabric, thereby providing a comfortable seating platform. The second textile border 32, like the first textile border 30, may be fastened to the rear rail 16 of the frame 12 in any number of ways known in the art. As shown in FIG. 2, for example, the second textile border 32 may be fastened to the rear rail 16 of the frame with standard upholstery staples 38. In one embodiment, the textile border 32 may be stretched before attachment to the rear rail 16 as described more fully below.

Figure 3:
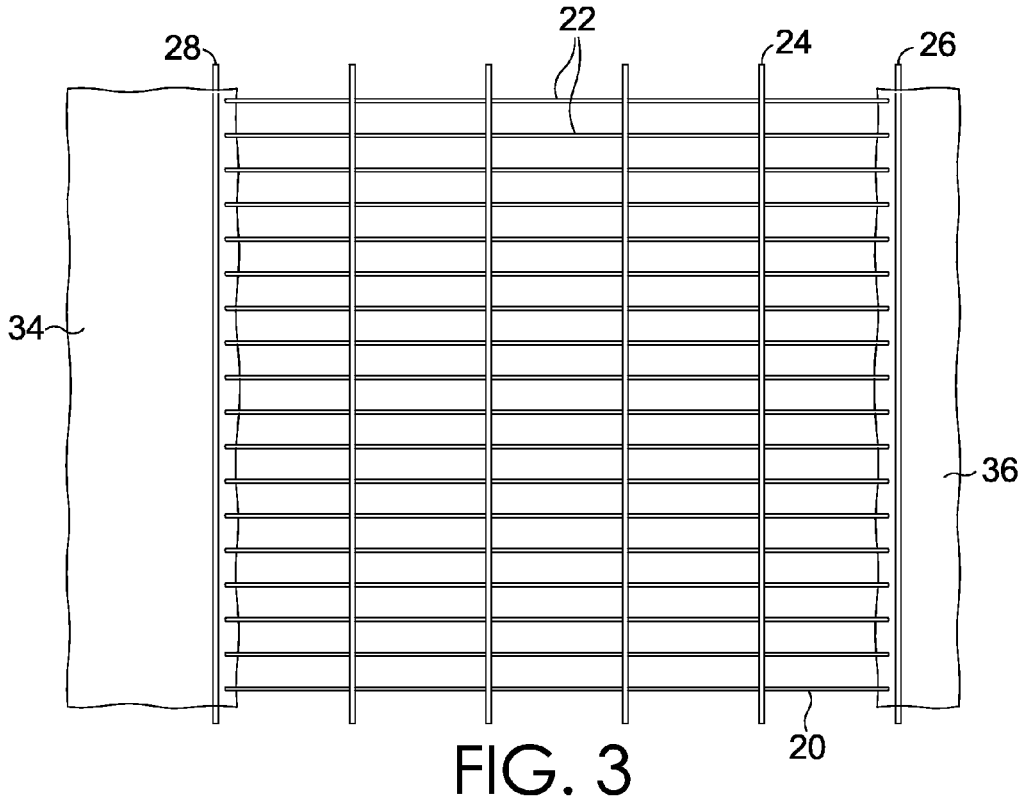
FIG. 3 is a top plan view of a decking portion of the seating product of FIG. 1 in accordance with an embodiment of the invention.
Figure 4:
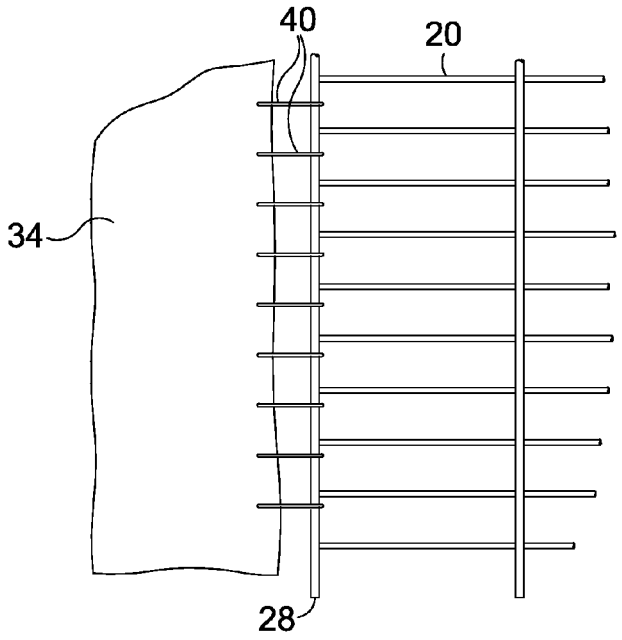
FIG. 4 is a top plan view of a portion of a decking in accordance with an embodiment of the invention.

Turning now to FIG. 3, there is illustrated a top plan view of a portion of the seating product illustrated in FIGS. 1 and 2. More specifically, FIG. 3 illustrates a top plan view of a wire grid assembly 20 having a first textile border 30 attached to a front side of the wire grid assembly 20 and disposed adjacent to a border wire 26. In one embodiment, as illustrated in FIG. 3, the first textile border 30 comprises a non-elastic fabric and is woven into the wire grid assembly 20 during manufacture. The wire grid assembly 20 illustrated in FIG. 3 further includes a second textile border 32 attached to a rear side of the wire grid assembly 20 and adjacent to a border wire 28. The second textile border 32 comprises an elastomeric fabric and is woven into the wire grid assembly 20 along the terminal ends of the spaced spring wires 22 on a rear side of the assembly in a manner similar to that discussed above. For example, in an embodiment, the second textile border 32 can comprise a laterally-stretchable fabric such as the fabric described in U.S. application Ser. No. 12/700,336. In an embodiment, as illustrated in FIG. 4, the second textile border 32 may be secured to the wire grid assembly 20 by one or more metal fasteners 40 disposed between the textile border 32 and the wire grid assembly 20. Similarly, the first textile border 30 can be attached to the wire grid assembly 20 in the manner described in FIG. 4 or in any other suitable manner.

The wire grid assembly 20 includes a plurality of spaced spring wires 22 that are held in place by a plurality of center cords 24. On a front side of the wire grid assembly, the spaced terminal ends of the spaced spring wires 22 are woven into the first textile border 30 such that the spaced spring wires 22 pierce the textile border 30. The spaced spring wires 22 may be secured to the border wire 26 by wrapping each spaced spring wire 22 around the border wire 26 and knotting the spaced spring wire 22.

Figure 5:
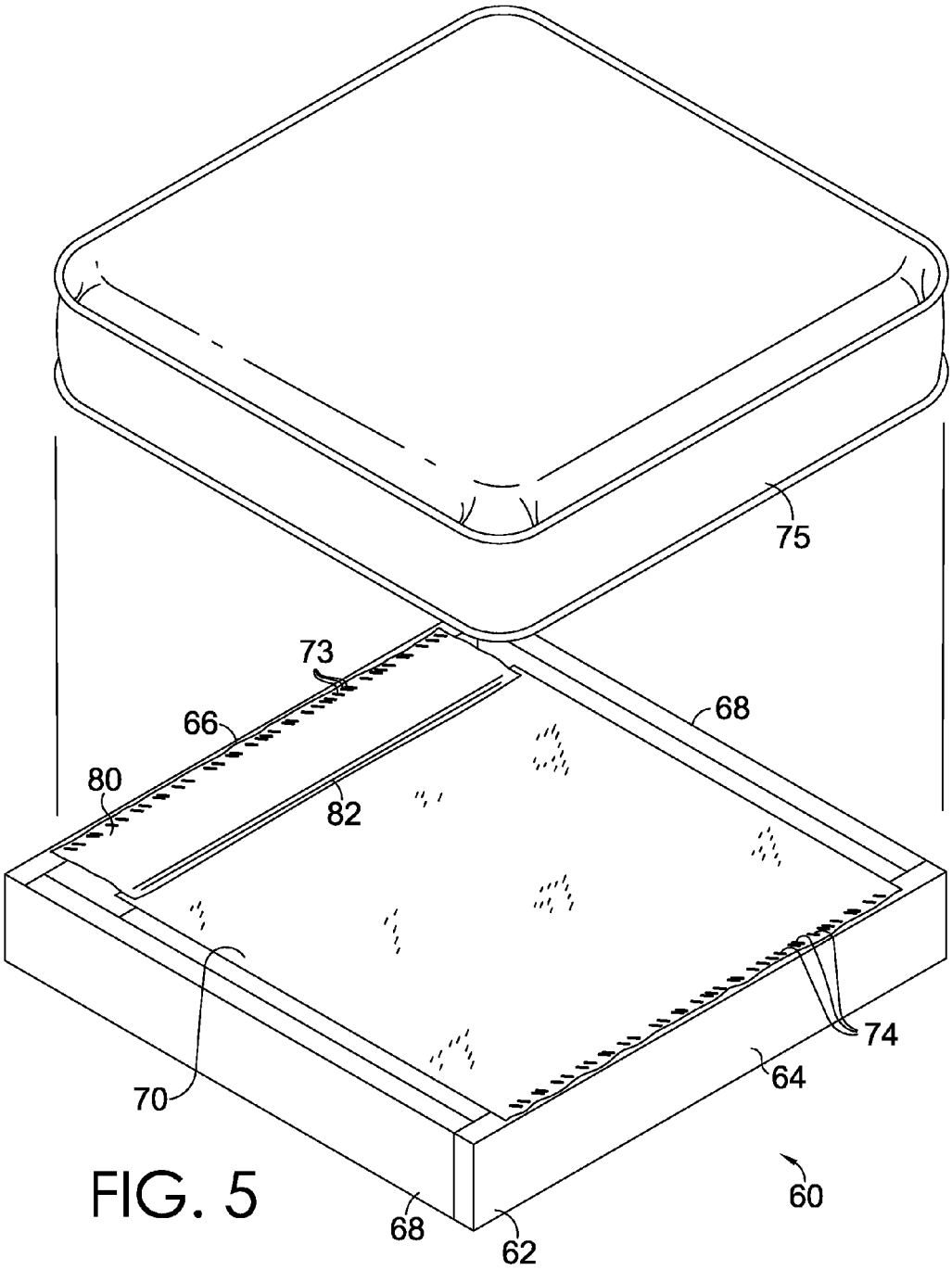
FIG. 5 is a perspective view of another seating product and an associated cushion in accordance with an embodiment of the invention.

Turning now to FIG. 5, there is illustrated a seating product 60, in accordance with other embodiments of the inventions. The seating product 60 may be, for example, a seat section or a back section of a chair, sofa, love seat, sectional, or any other component of furniture. The seating product 60 comprises a frame 62 and a fabric seat deck 70 secured to the frame. According to some embodiments, the fabric seat deck 70 can be a single piece of strong fabric such as, for example, woven polypropylene fabric, woven nylon fabric, and the like. As depicted in FIG. 5, a cushion 75 can simply be positioned atop the fabric seat deck 70 as shown. In other embodiments, the fabric seat deck 70 itself can serve as the primary seating surface and can be covered in various materials, coated, finished, and the like, for any number of aesthetic appearances.

As illustrated in FIG. 5, the frame 62 comprises a front rail 64, a rear rail 66 and a pair of opposed side rails 68. The front and rear rails 64, 66 comprise a pair of opposed rails. The frame 62 may be constructed by any material known and used in the art, but is typically constructed from wood. The size of the frame 62 will vary depending on the application, and may be adapted for use, for example, as a seat section or a seat back of a piece of furniture.

The fabric deck 70 is illustrated in FIG. 5 as extending between the front rail 64 and the rear rail 66 of the frame 62. The fabric deck 70 includes any number of types of fabric. In some embodiments, the fabric deck 70 is a single piece of fabric, and in other embodiments, fabric deck 70 includes a number of pieces of fabric. Different types of fabric can provide different aesthetics and functionality. For example, according to an embodiment, the fabric deck 70 comprises a single piece of woven polypropylene, which is a strong and affordable fabric. According to other embodiments, the fabric deck 70 can comprise woven nylon, a more expensive fabric, if greater strength and/or aesthetic appeal is desired.

The fabric deck 70 extends between the front rail 64 of the frame 62 and the rear rail 66 of the frame 62. A front end of the fabric deck 70 is coupled to the front rail 64 of the frame 62. As shown in FIG. 5, the fabric deck 70 can be coupled directly to front rail 64 of the frame. For example, in an embodiment, fabric deck 70 can be secured to the frame 62 using standard upholstery staples 74.

Figure 6:
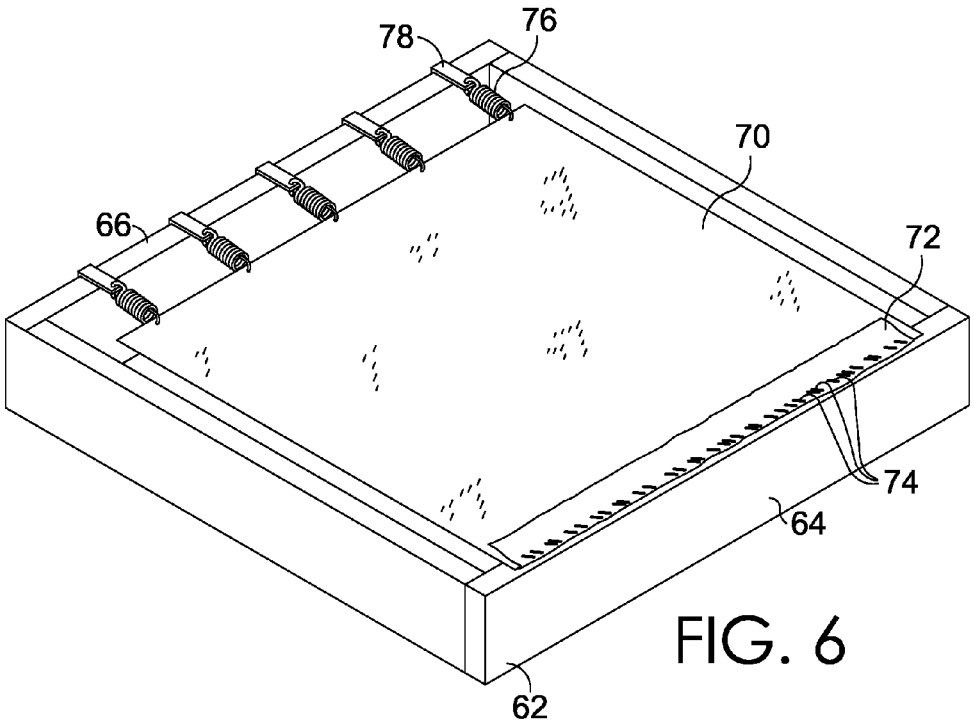
FIG. 6 is a perspective view of a frame of an article of furniture with a helical spring decking in accordance with an embodiment of the invention.
Figure 7:
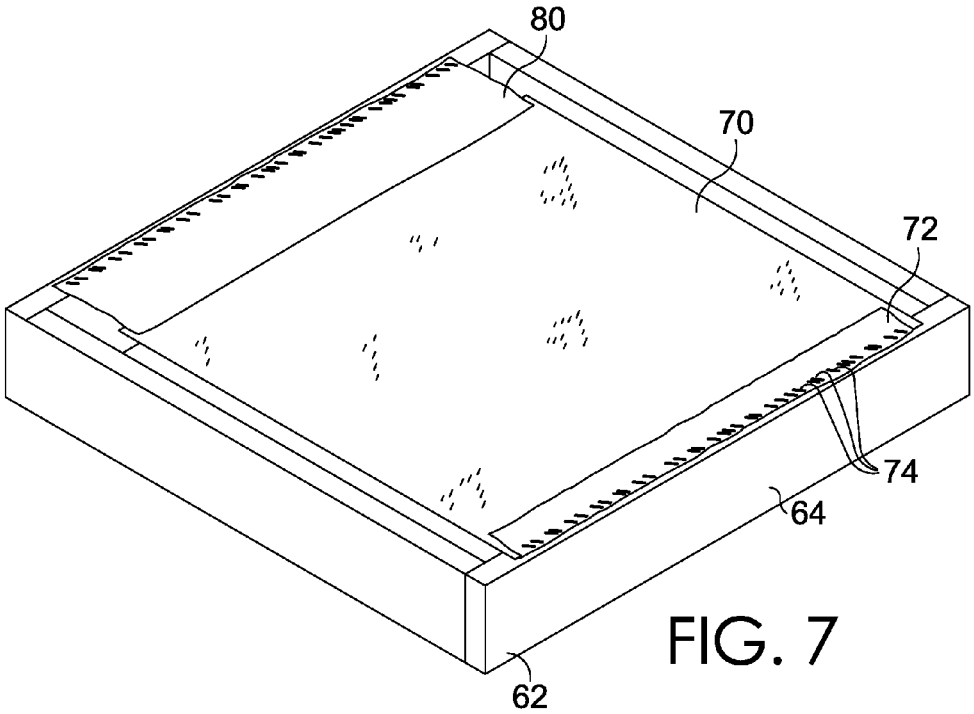
FIG. 7 is a perspective view of a frame of an article of furniture with a fabric decking in accordance with an embodiment of the invention

Turning briefly to FIG. 7, embodiments of the inventions include embodiments in which this coupling is achieved by disposing a textile border 72 between the fabric deck 70 and the front rail 64 of the frame 62. This textile border 72 may be made of elastomeric fabric or non-elastic fabric. The textile border may be secured to the fabric deck 70, for example by weaving the border into the fabric deck 70 during manufacture. In other embodiments, the textile border 72 may be secured to the fabric deck 70 by any number of other methods. For example, textile border 72 can be sewn to fabric deck 70 using a series of stitches. The textile border 72 may be further secured to the frame 62 with standard upholstery staples 74, as shown in FIG. 6.

Returning to FIG. 5, the fabric deck 70 may be flexibly coupled to the rear rail 66 of the frame 62. The flexible coupling may be achieved, for example, by disposing a second textile border 80 between the fabric deck 70 and the rear rail 66 of the frame 62. As with the first textile border 72 described above with reference to FIG. 7, the second textile border 80 may be made of elastomeric fabric or non-elastic fabric. For example, the textile border of the present invention may be made of any number of woven or nonwoven fabric materials. One such type of webbing material is a polyester material trademarked "SYTEX®", manufactured by the MATREX® division of Leggett & Platt®, Incorporated. A second alternative type of webbing material suitable for making a textile border used in the present invention is a woven polypropylene material containing rubber or elastomeric filaments. In other embodiments, the textile border 80 can be a length of a laterally-stretchable warp knit fabric, as described in U.S. application Ser. No. 12/700,336.

With reference to FIG. 6, a seating product according to embodiments of the invention may have a fabric seat deck 70 disposed between a front 64 and rear rail 66 of a frame 62, wherein a front side of the fabric seat deck 70 is flexibly coupled to the frame 62 by disposing a non-elastic textile fabric 72 between the front rail 64 of the frame 62 and the fabric seat deck 70. The fabric seat deck 70 may further be flexibly coupled to the rear rail 66 of the frame 62 by disposing a plurality of helical springs 76 between the fabric seat deck 70 and the rear rail 66 of the frame 62. Each of the helical springs 76 may be secured to the fabric seat deck 70 at one end of the helical spring 76 and attached to a metal hangar 78 that is secured to the rear rail 66 of the frame 62 at an opposite end of the helical spring 76.

With reference to FIG. 7, a fabric seat deck 70 is illustrated as extending between the front rail 64 and the rear rail 66 of the frame 62. A front end of the fabric deck 70 is coupled to the front rail 64 of the frame 62. As shown in FIG. 6, embodiments of the inventions include embodiments in which this coupling is achieved by disposing a textile border 72 between the fabric deck 70 and the front rail 64 of the frame 62. This textile border 72 may be made of elastomeric fabric or non-elastic fabric. The textile border may be secured to the fabric deck 70, for example by weaving the border into the fabric deck 70 during manufacture. In other embodiments, the textile border 72 may be secured to the fabric deck 70 by any number of other methods. For example, textile border 72 can be sewn to fabric deck 70 using a series of stitches. The textile border 72 may be further secured to the frame 62 with standard upholstery staples 74, as shown in FIG. 7.

With continued reference to FIG. 7, the fabric deck 70 may be flexibly coupled to the rear rail 66 of the frame 62. The flexible coupling may be achieved, for example, by disposing a second textile border 80 between the fabric deck 70 and the rear rail 66 of the frame 62. As with the first textile border 72 described above with reference to FIG. 5, the second textile border 80 may be made of elastomeric fabric or non-elastic fabric. For example, in some embodiments, the textile border 80 can be a length of a laterally-stretchable warp knit fabric, as described in U.S. application Ser. No. 12/700,336.

Figure 8:
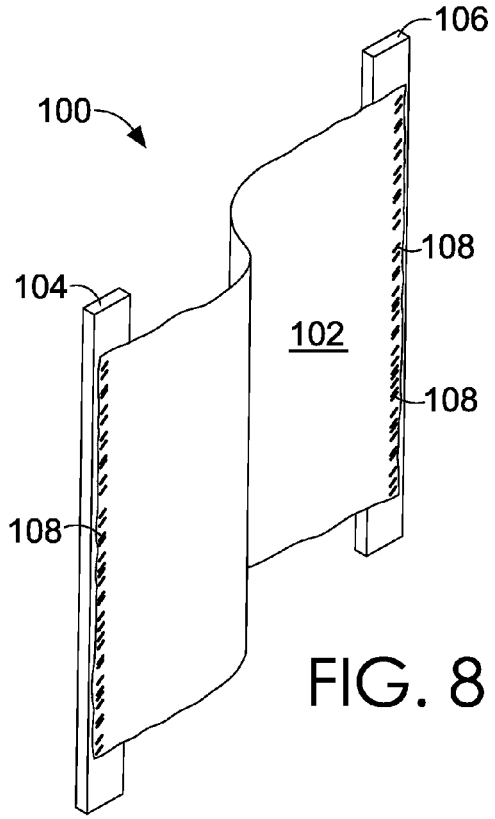
FIG. 8 is a perspective view depicting an elastomeric decking material attached to a pair of frame rails in accordance with an embodiment of the invention.

With reference now to FIGS. 8-16 components, apparatus, and methods for installing a decking in an article of furniture are described. Turning initially to FIG. 8, a deck assembly 100 is depicted. The deck assembly 100 includes a decking 102, a front frame rail 104, and a rear frame rail 106. The decking 102 comprises any combination of elastomeric and non-elastomeric fabrics, wire grids, and other components as described above. In an embodiment, the decking 102 comprises a single section of an elastomeric fabric, as depicted in FIG. 8. The decking 102 is manufactured or cut to a desired length and width based on the design specifications of an article of furniture into which the deck assembly 100 is to be installed and based on the amount of tension or stretching that is to be imparted in the decking 102.

The front and rear frame rails 104, 106 comprise any desired material, and typically are made of wood. The decking 102 is attached to the front and rear frame rails 104, 106 along opposing edges of the decking 102 by any methods used in the art. In an embodiment, the decking 102 is attached to the front and rear frame rails 104, 106 using a plurality of standard upholstery staples 108. Further, the decking 102 is attached to the front and rear frame rails 104, 106 while in a relaxed state, e.g. while the decking 102 is not under tension.

Current methods used in the art require attaching an edge of a decking material to a frame of an article of furniture and then grasping and pulling the opposite edge to stretch the material over the frame while installing upholstery staples to secure the opposite edge to the frame. Such methods are difficult for operators and may lead to ripping or tearing of the decking materials and excess waste of the materials, among other drawbacks. By attaching the decking 102 to the front and rear frame rails 104, 106 in a relaxed state operator difficulties and the risks of tearing, ripping, or otherwise harming the decking material 102 during attachment are eliminated or greatly reduced over current methods. And the decking material 102 can be cut or manufactured to size without providing additional excess material for gripping and stretching.

As will be described in greater detail below and depicted in FIG. 9, the deck assembly 100 is installed on a frame 110. The frame 110 includes a front side 112, a rear side 114, and a pair of opposing ends 116, 118. The frame 110 may be constructed from any material known and used in the art, but is typically constructed from wood. The frame 110 includes any dimensions suitable for use with an associated article of furniture.

Figure 9:
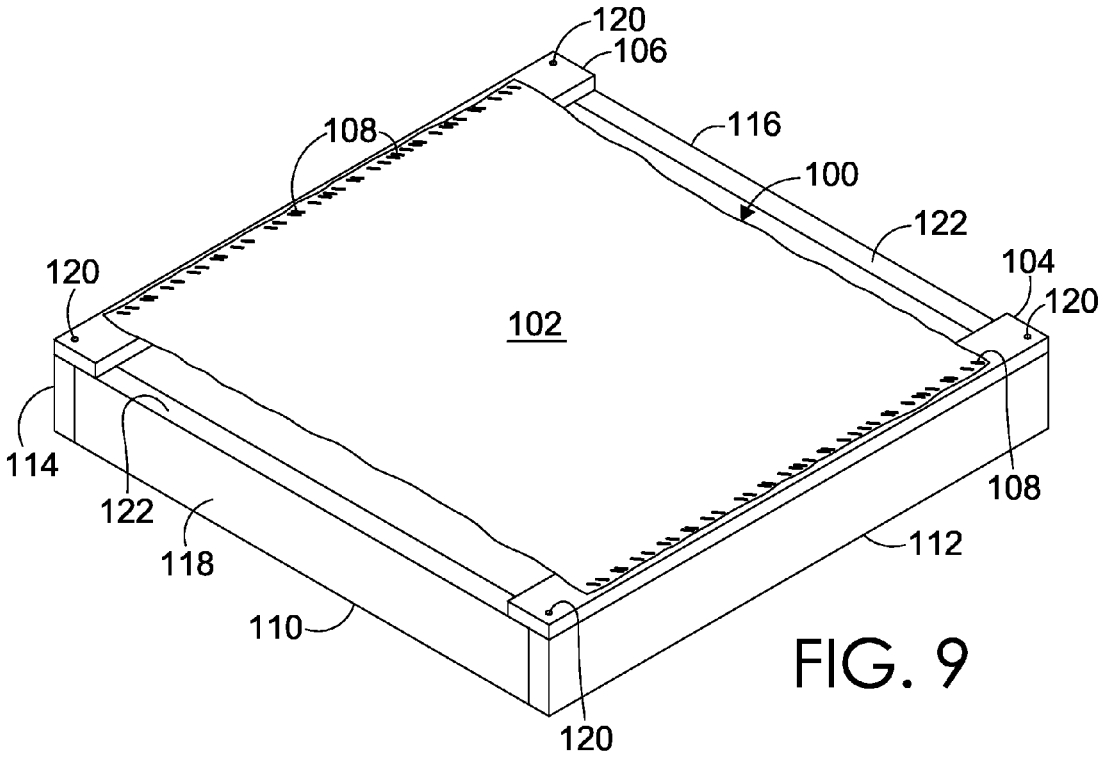
FIG. 9 is a perspective view of a frame of an article of furniture with an attached elastomeric decking depicted in accordance with an embodiment of the invention.

As depicted in FIG. 9, in an assembled condition, the front frame rail 104 of the deck assembly 100 is coupled to the front side 112 and the rear frame rail 106 is coupled to the rear side 114 of the frame 110 using any fastener 120 or coupling used in the art, e.g. screws, nails, bolts, or the like. In an embodiment, the front and/or rear frame rails 104, 106 are integral with the front and rear sides 112, 114 of the frame. In the assembled condition, the decking 102 is stretched between the front and rear frame rails 102, 104 to provide a desired amount of tension or firmness.

Figure 10:
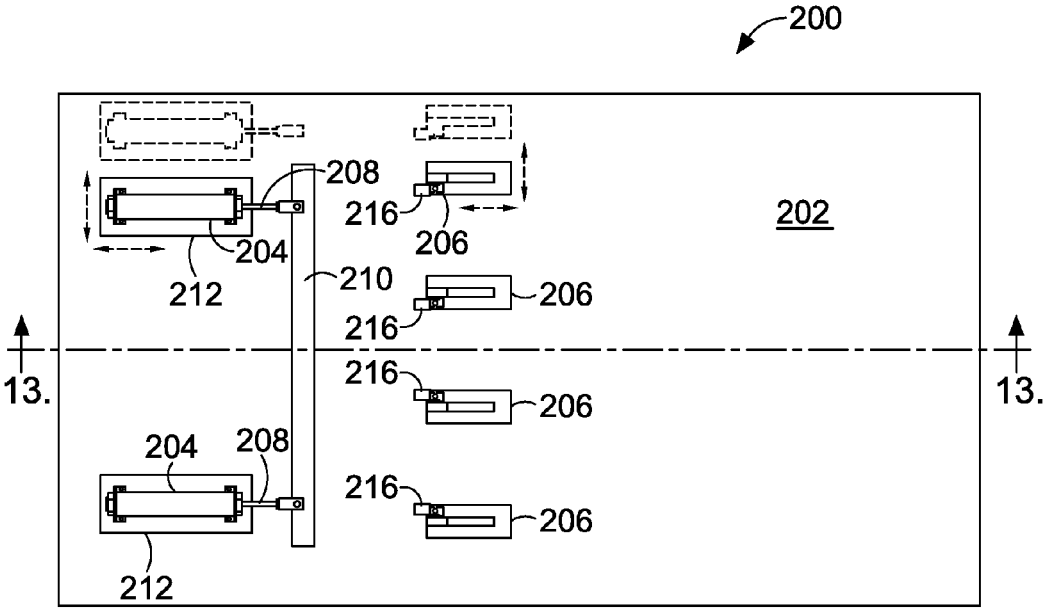
FIG. 10 is a top plan view of an apparatus for installing a fabric decking material in a frame of an article of furniture in accordance with an embodiment of the invention.

Turning now to FIG. 10, an apparatus 200 for installing the deck assembly 100 on the frame 110 of an article of furniture is described in accordance with an embodiment of the invention. The apparatus 200 includes a surface 202, a pair of actuators 204 and a plurality of fixtures 206. The surface 202 is any surface, table, workstation, or the like that is suitable to support the actuators 204, the fixtures 206, and the frame 110 of an article of furniture during installation of the deck assembly 100. The surface 202 may include features (not shown) for properly locating the frame 110 or that provide indications for positioning a plurality of different frames 110 from various articles of furniture. The surface 202 might also include one or more features (not shown) that provide adjustability of the location of the actuators 204 and/or the fixtures 206.

Figure 11:
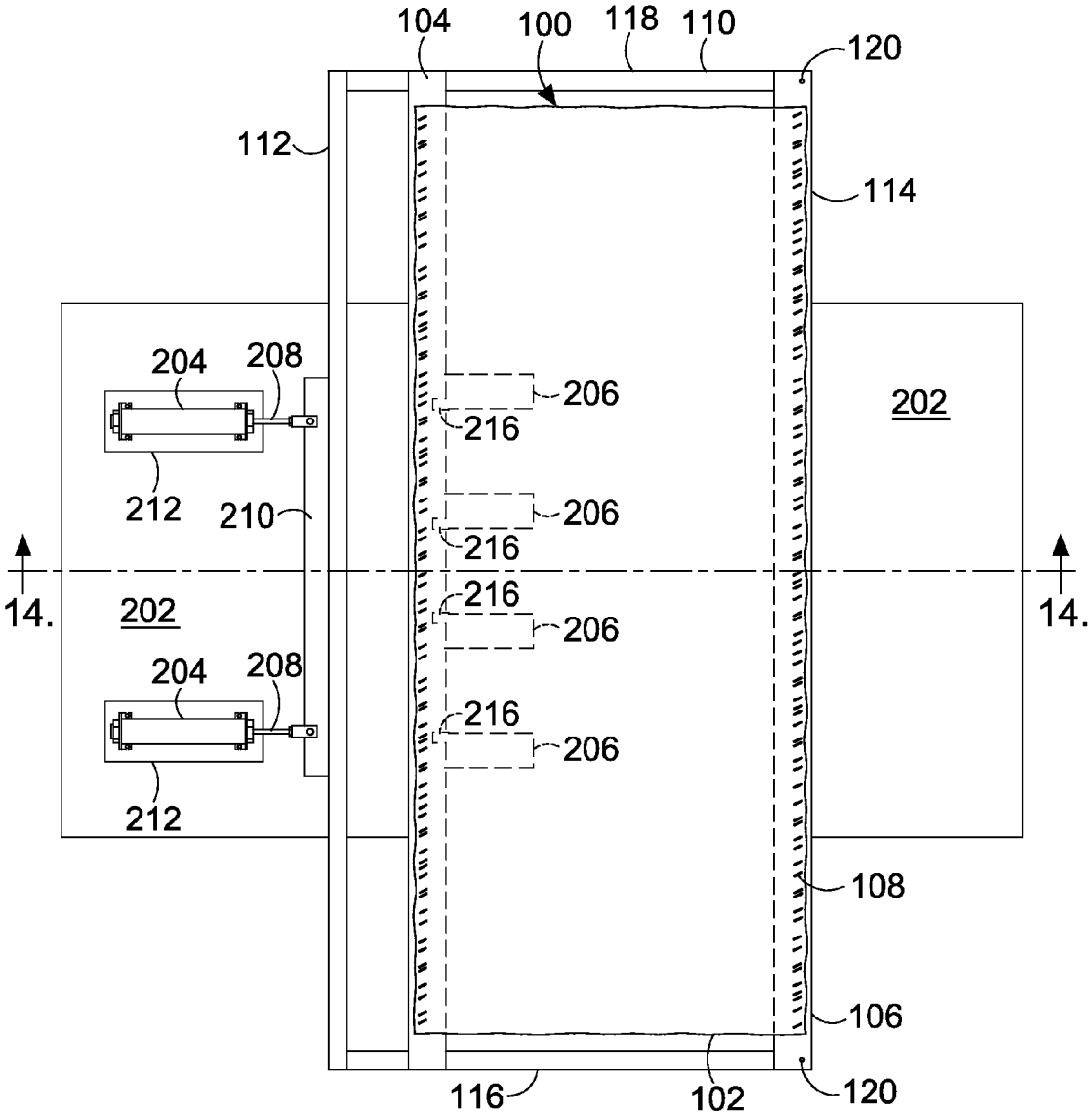
FIG. 11 is a top plan view of the apparatus of FIG. 10 with a frame of an article of furniture and an un-tensioned fabric decking section disposed thereon in accordance with an embodiment of the invention.
Figure 12:
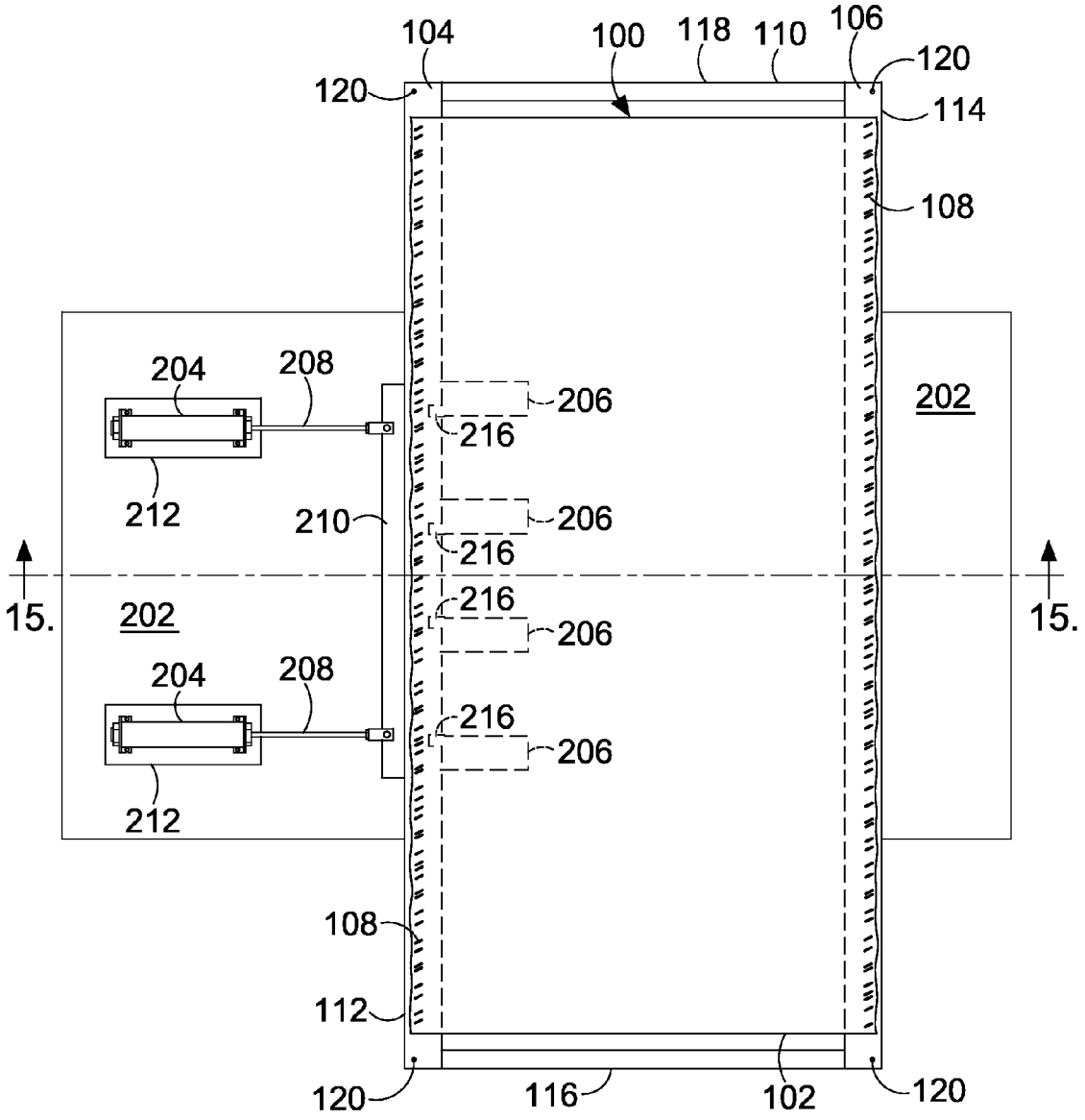
FIG. 12 is a top plan view of the apparatus of FIG. 11 with the fabric decking section tensioned and coupled to the frame in accordance with an embodiment of the invention.
Figure 13:
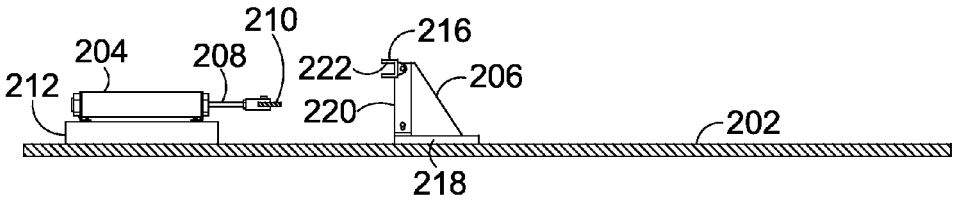
FIG. 13 is an elevational view of the apparatus of FIG. 10 depicted along line 13-13 in accordance with an embodiment of the invention.
Figure 14:
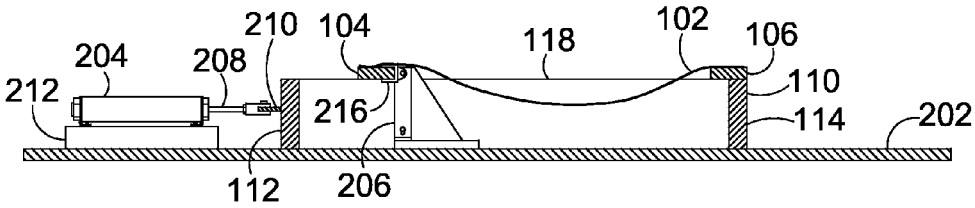
FIG. 14 is an elevational view of the apparatus of FIG. 11 depicted along line 14-14 in accordance with an embodiment of the invention.
Figure 15:
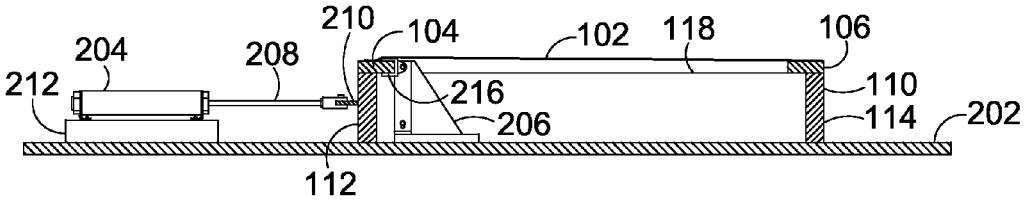
FIG. 15 is an elevational view of the apparatus of FIG. 12 depicted along line 15-15 in accordance with an embodiment of the invention.
Figure 16:
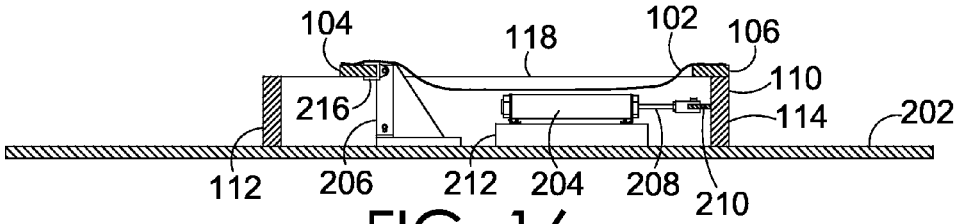
FIG. 16 is an elevational view of an apparatus for installing a fabric decking in a frame of an article of furniture in accordance with another embodiment of the invention.

The actuators 204 comprise any type of actuator known in the art. As depicted in FIGS. 10-12, in an embodiment, the actuators 204 include pneumatic or hydraulic cylinders (various components associated with pneumatic and hydraulic cylinders, such as tubing, pumps, and the like are not depicted for sake of clarity). But, the actuators 204 might also include an electronic actuator or a mechanical hand-driven actuator, among a variety of others. A pair of actuators 204 is depicted in FIGS. 10-12 however any number of actuators might be employed.

The actuators 204 each include a piston rod 208 that is coupled to a push bar 210. The push bar 210 is configured to contact the front or rear side 112, 114 of the frame 110 and to apply a force thereto. As such, the push bar 210 may include a broad, flat surface to distribute the force across the front or rear side 112, 114 of the frame 110 and to avoid damaging the side 112, 114 of the frame. The push bar 210 might also be configured to cooperate with any features, shapes, or other characteristics of the frame 110. For example, a frame might include bowed or non-planar side and the push bar 210 might include with a similar non-planar configuration. In an embodiment, the push bar 210 aids to equally distribute the force applied between the two actuators 204 and to equalize the length of the stroke. The push bar 210 may also include one or more features to aid in maintaining the position of the frame 110 with respect to the push bar 210 during installation of the deck assembly 100. In another embodiment, each of the actuators 204 includes a separate push bar 210. In such an embodiment, the force applied by the actuators might be equalized through the use of valves or supply/return lines used to propel the actuators 204. Or the actuators 204 might each be configured to apply a different amount of force and/or stroke length.

In an embodiment, the actuators 204 are mounted on a base 212. The bases 212 elevate the actuators 204 to a desired height for application of the force on the frame 110. In an embodiment, the bases 210 are not employed. In such an embodiment, the actuators 204 are mounted to the surface 202 directly and the push bar 210 might be configured to apply the force at the desired height. The bases 212 are coupled to the surface 202 to rigidly maintain the position of the actuators 204 during installation of the deck assembly 100.

The fixtures 206 are configured to receive and rigidly maintain one of the front or rear frame rails 104, 106 against an applied force. The fixtures 206 are constructed from any desired materials, such as metals, wood, plastics, composites, or the like. Four fixtures 206 are depicted in FIGS. 10-12 however any number of fixtures 206 can be used. The fixtures 206 are rigidly coupled to the surface 202 using any desired fasteners, e.g. bolts. In an embodiment, the fixtures 206 are removable from the surface 202 and their location may be adjusted. In another embodiment, the fixtures 206 are arranged on the surface to accommodate frames from one or more different articles of furniture.

The fixtures 206 include a body 214 and a receptacle 216. As depicted in FIGS. 13-16, the body 214 of the fixture 206 has a right triangular form arranged with a first leg 218 of the triangle contacting the surface 202 and a second leg 220 standing perpendicular to the surface 202 and facing toward the actuators 204. In another embodiment, the body 214 includes any desired form or shape.

The receptacle 216 is mounted on the body 214 at an end of the second leg 220 distal to the surface 202. The receptacle 216 provides a slot 222 into which the front or rear frame rail 104, 106 can be removeably received. The receptacle 216 rigidly maintains the front or rear frame rails 104, 106 against movement into the slot 222 and rotation about the slot 222 when a force is applied to the frame rail 104, 106 as described below. In an embodiment, the receptacles 216 are adjustable to different heights and different slot 222 widths to accommodate various frames 110 and frame rails 104, 106.

The fixtures 206 are further configured to align the frame rail 104, 106 disposed therein with a respective side 112, 114 of the frame 110. As depicted in FIGS. 8 and 13-15, the frame rails 104, 106 are aligned with a top surface 122 of the frame 110. In another embodiment, the frame rails 104, 106 are aligned with any desired feature or location on the frame 110. For example, in a particular design, the frame rails might fit within the frame and may be attached to a ledge or other feature interior to the frame.

As depicted in FIGS. 10-15, the actuators 204 and the fixtures 206 are coupled to the surface 202 such that the frame 110 of an article of furniture is disposed around the fixtures 206 with a side 112, 114 of the frame 110 being between the actuators 204 and the fixtures 206. It is to be understood that various other configurations might be employed without departing from the scope of embodiments of the invention described herein. For example, in an alternative embodiment depicted in FIG. 16, the actuators 204 are positioned on an opposite side of the fixtures 206. As such, the frame 110 is disposed around both the actuators 204 and the fixtures 206 and the actuators 204 apply a force to an interior wall of the frame 110. In another embodiment, the actuators are coupled to a side 112, 114 of the frame 110 and pull the frame 110 rather than push the frame 110 (not shown).

Figure 17:
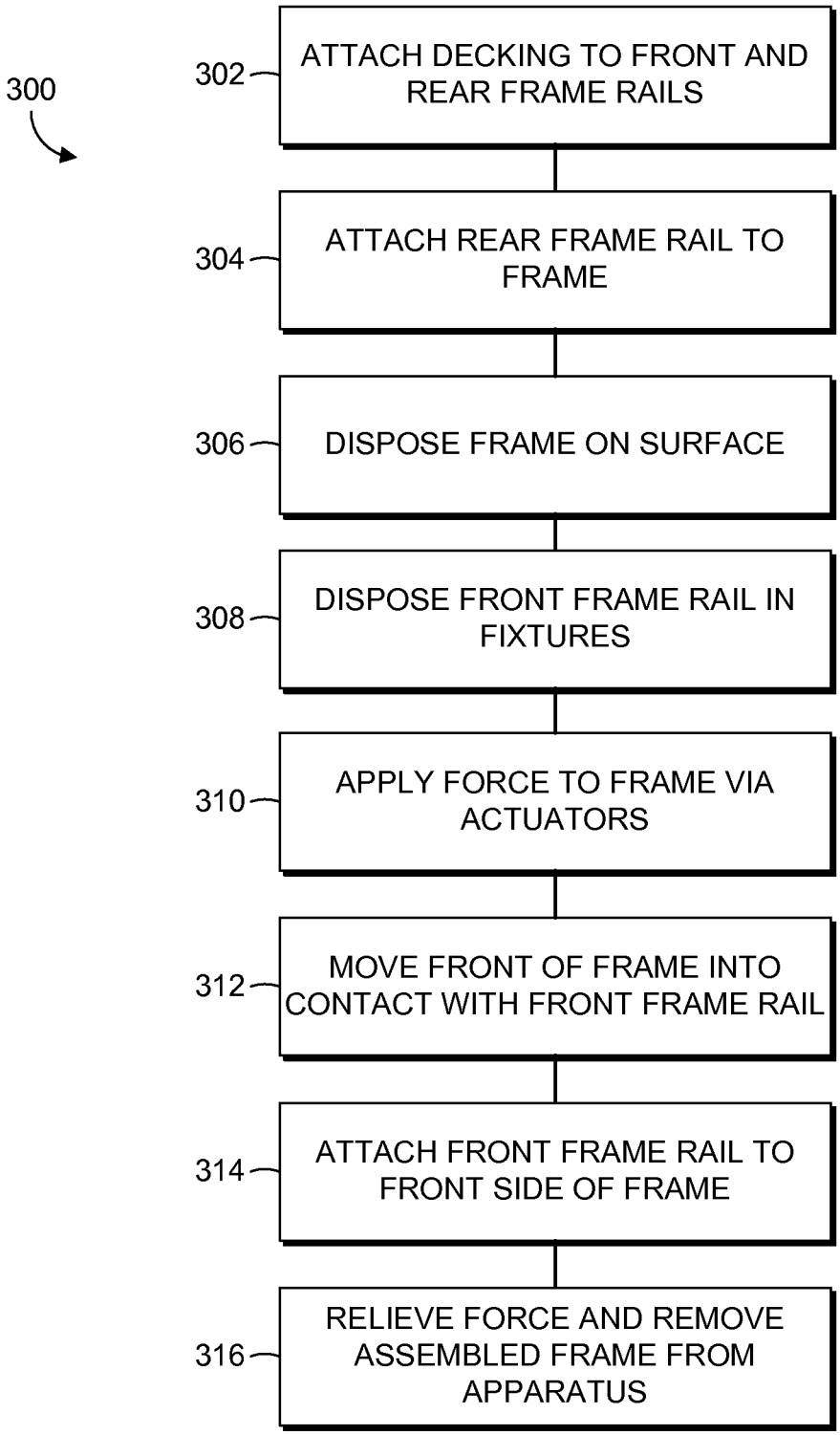
FIG. 17 is a flow diagram of a method for installing a deck assembly in an article of furniture in accordance with an embodiment of the invention.

With reference now to FIG. 17, a method 300 for installing the deck assembly 100 in the frame 110 is described in accordance with an embodiment of the invention. The decking 102 is attached to the front and rear frame rails 104, 106 to form the deck assembly 100, as indicated at a step 302. The decking 102 is attached using a plurality of standard upholstery staples 108. In another embodiment the decking 102 is attached using any desired method including, for example, adhesives, glues, tacks, clamps, or the like. In an embodiment, the decking 102 is only attached to the front frame rail 104 and the rear frame rail 106 is omitted.

As indicated at a step 304, the rear frame rail 106 is attached to the rear side 114 of the frame 110. The attachment is made using any desired fasteners 120, such as, screws, nails, bolts, or the like. In embodiments in which the rear frame rail 106 is omitted, the decking 102 is directly attached to the rear side 114 of the frame using standard upholstery staples 108 or any other desired method.

The frame 110, with the deck assembly 100 attached to the rear side 114 thereof is disposed on the surface 202, as indicated at a step 306. The frame 110 is placed on the surface 202 such that the front side 112 of the frame 110 lies between the fixtures 206 and the push bar 210 of the actuators 204. The front frame rail 112 is disposed in the slots 222 of the receptacles 216 on the fixtures 206 as indicated at a step 308. Embodiments are described herein in which the rear frame rail 106 is attached to the frame 110 and the front frame rail 104 is disposed in the fixtures 206, however it is to be understood that the attachment might be reversed, e.g. the front frame rail 104 might be attached to the front of the frame 112 and the rear frame rail 106 disposed in the fixtures 206, without departing from the scope of embodiments of the invention described herein.

At a step 310, the actuators 204 are activated to press the push bar 210 against the front side 112 of the frame 110 and apply a force thereto. The actuators 204 apply a force great enough to slide the frame 110 across the surface 202 and to stretch the decking material 102. The actuators 204 continue to apply the force and move the frame 110 until the front frame rail 104 contacts the front side 112 of the frame 110 or achieves a desired alignment with the frame 110, as indicated at a step 312. The distance that the actuators 204 move the frame 110 and the width of the decking 102 are configured to provide a desired amount of tension in the decking 102.

The front frame rail 104 is coupled to the front side 112 of the frame 110 using any desired fasteners 120, as indicated at a step 314. The actuators 204 are unloaded and/or reversed to relieve the force on the frame 110 and the front frame rail 104 is removed from the receptacles 216 of the fixtures 206, as indicated at a step 316. The frame 110 with the installed deck assembly 100 is removed from the apparatus 200 and installed in an article of furniture as desired.

In embodiments of the invention, installation of the deck assembly 100 as described above provides uniform tension across the decking 102 while reducing or eliminating rips, cuts, or tears in the decking, and reducing material waste. The installation is much less labor intensive and time consuming for operators than prior methods involving pulling or stretching the decking by hand and attaching the decking to the frame while under tension. And embodiments of the invention may be more easily automated to increase production and decrease risks of operator injury, among other benefits.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A method for installing a deck assembly in an article of furniture, the method comprising:

attaching a deck assembly to a first side of a frame of an article of furniture, the deck assembly including a decking and a first frame rail, a first edge of the decking being attached to the first side of the frame by the first frame rail and a second opposite edge of the decking being attached to a second frame rail, and the frame including the first side, an opposing second side, and a pair of opposing ends;

removeably disposing the second frame rail in a fixture;

applying a force on the frame to move the opposing second side of the frame toward the second frame rail and to stretch the decking between the second frame rail and the first side of the frame; and attaching the second frame rail to the opposing second side of the frame.

2. The method of claim 1, wherein the decking comprises an elastomeric textile.

3. The method of claim 1, wherein the decking includes a body and at least one first textile border coupled to the body and extending between the body and the first side of the frame, thereby coupling a first side of the body to the frame.

4. The method of claim 3, wherein the at least one first textile border comprises an elastomeric fabric.

5. The method of claim 3, wherein the decking further comprises a second textile border coupled to the body and extending between the body and the frame rail, thereby flexibly coupling a second side of the body to the frame rail.

6. The method of claim 5, wherein the second textile border comprises an elastomeric fabric.

7. The method of claim 3, wherein the body comprises a wire grid with the first textile border coupled along at least one edge.

8. The method of claim 7, wherein the first textile border is coupled to the wire grid by weaving the border into the wire grid.

9. The method of claim 1, wherein one or more of a pneumatic, hydraulic, mechanical, or electronic actuator applies the force on the frame.

10. The method of claim 9, wherein the actuator and the fixture are rigidly coupled to a surface and the frame is slidably disposed on the surface with the second side placed between the actuator and the fixture such that the actuator applies the force to the second side of the frame to move the second side toward the fixture.

11. The method of claim 9, wherein the actuator and the fixture are disposed interior to the frame and the actuator applies the force to the first side of the frame to move the second side of the frame toward the fixture.

12. The method of claim 1, wherein the first edge of the decking is coupled to a second frame rail and the second frame rail is coupled with the first side of the frame.

13. An apparatus for installing a decking assembly in an article of furniture, the apparatus comprising:

a rigid fixture configure to removeably accept a frame rail of a decking assembly for an article of furniture and to rigidly retain the frame rail against an applied force, the decking assembly including a decking that is coupled to the frame rail along a first edge and coupled to a first side of the frame of the article of furniture along a second edge, the frame including the first side, an opposing second side, and a pair of opposing ends;

an actuator configured to apply a force on the frame to move the second side of the frame toward the frame rail that is retained in the fixture; and a surface configured to support the frame and to rigidly couple to the fixture and the actuator.

14. The apparatus of claim 13, wherein the decking comprises an elastomeric textile.

15. The apparatus of claim 13, wherein the decking includes a body and at least one first textile border coupled to the body and extending between the body and one of the frame rail or the first side of the frame, thereby coupling the body to the frame rail or the first side of the frame.

16. The apparatus of claim 13, wherein the at least one first textile border comprises an elastomeric fabric.

17. The apparatus of claim 13, wherein one or more of the fixture and the actuator are adjustable to accommodate frames from multiple different articles of furniture.

18. A seating product comprising:

a frame having a first side, an opposing second side, and a pair of opposing ends; and a deck assembly having a frame rail coupled along a first edge of a decking, the decking including an elastomeric textile and being installed in the frame by attaching a second edge of the decking to the first side of the frame, the second edge being opposite the first edge, placing the frame rail in a fixture, applying a force to the frame to move the second side of the frame toward frame rail in the fixture and to stretch the decking between the first side of the frame and the frame rail, and coupling the frame rail to the second side of the frame.

19. The seating product of claim 18, wherein the decking assembly includes a second frame rail that is coupled along the second edge of the decking and is attached to the first side of the frame.

20. The seating product of claim 18, wherein the decking includes a body and at least one textile border that is secured to a first edge of the body by weaving the textile border into the body during manufacture, the textile border thereby forming the first or second edge of the decking.

* * * * *